US011516569B1

(12) United States Patent
Kervran

(10) Patent No.: US 11,516,569 B1
(45) Date of Patent: Nov. 29, 2022

(54) CAPACITIVE MICROPHONE

(71) Applicant: AAC ACOUSTIC TECHNOLOGIES (SHENZHEN) CO., LTD., Shenzhen (CN)

(72) Inventor: Yannick Pierre Kervran, Hk (FR)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 30 days.

(21) Appl. No.: 17/342,510

(22) Filed: Jun. 8, 2021

(51) Int. Cl.
*H04R 1/08* (2006.01)
*H04R 7/16* (2006.01)

(52) U.S. Cl.
CPC ..... *H04R 1/08* (2013.01); *H04R 7/16* (2013.01)

(58) Field of Classification Search
CPC . H04R 1/08; H04R 7/16; H04R 19/00; H04R 19/04
See application file for complete search history.

(56) References Cited

U.S. PATENT DOCUMENTS

2015/0001647 A1* 1/2015 Dehe ..... H04R 31/00 257/416
2016/0219378 A1* 7/2016 Hall ..... H04R 19/04
2018/0152792 A1* 5/2018 Hoekstra ..... H04R 19/04
2021/0211793 A1* 7/2021 Wu ..... H04R 19/005

* cited by examiner

*Primary Examiner* — Tuan D Nguyen
(74) *Attorney, Agent, or Firm* — W&G Law Group

(57) ABSTRACT

A capacitive microphone includes a substrate, a plurality of stationary electrodes, a diaphragm, and a backplate. The substrate includes a cavity and a step disposed in the cavity, and the plurality of stationary electrodes is equally spaced on the step. A diaphragm is received in the step and includes a vibration portion and a connecting portion connected to the vibration portion. A plurality of movable electrodes protrudes from a periphery of the vibration portion, and one end of the connecting portion away from the vibration portion is connected to the substrate. The backplate is provided with a plurality of sound transmission holes, and a gap is formed between the backplate and the diaphragm to form electrode plates of a variable capacitor. The capacitive microphone can get a higher signal-to-noise ratio, improve the capability of suppressing linear distortion, and improve the anti-interference capability of the microphone.

10 Claims, 5 Drawing Sheets

CAPACITIVE MICROPHONE

TECHNICAL FIELD

The present disclosure relates to the technical field of microphones, and in particular, to a capacitive microphone.

BACKGROUND

With the development of wireless communication, more customers use mobile phones. The customers' requirements for a mobile phone not only include telephoning function, but also can achieve a high quality call. In particular, with the development of a mobile multimedia technology, the call quality of mobile phones is more important. The microphone of the mobile phone is used as a voice pickup device of the mobile phone, so that the design of the microphone directly affects the call quality.

As so far, a micro-electro-mechanical-system (MEMS) Microphone is widely used and has good performance. FIG. 1 is a schematic cross-sectional view of a microphone in the related art. The microphone 10 includes a backplate 11 and a diaphragm 12, which is opposite to the backplate 11 and connected to the backplate 11 through a connecting portion 121. The diaphragm 12 may vibrate upwards and downwards relatively to the backplate 11. The backplate 11 is further provided with a sound transmission hole 111. The sound transmission hole 111 transmits a sound airflow to the diaphragm 12 and cause the diaphragm 12 to vibrate. A sound cavity 13 is formed between the diaphragm 12 and the backplate 11. Each of the diaphragm 12 and the backplate 11 is provided with a conductive layer and can be energized, but the energized portions are insulated from each other. In this way, the diaphragm 12 and the backplate 11 form a capacitor with a capacitance. However, since the capacitance is directly proportional to a surface area of each of two capacitive plates of the capacitor and is inversely proportional to a distance between the two capacitive plates of the capacitor, the vibration deformation of the microphone diaphragm 12 with this structure is greatly affected by the interference of the electric field force. This may result in a curvilinear change of the distance between the diaphragm 12 and the backplate 11. Therefore, the capacitive microphone with this structure has poor linearity, poor sensitivity, poor audio loudness, and high noise.

SUMMARY

The present disclosure provides a capacitive microphone, which can improve the performance of the capacitive microphone.

The capacitive microphone includes a substrate, a plurality of stationary electrodes, a diaphragm, and a backplate. The substrate includes a cavity and a step disposed in an upper portion of the cavity, and the cavity penetrates through the substrate. The plurality of stationary electrodes is equally spaced on the step. The diaphragm is received in the step and includes a vibration portion and a connecting portion connected to the vibration portion, a plurality of movable electrodes protrudes from a periphery of the vibration portion, and one end of the connecting portion away from the vibration portion is connected to the substrate. The backplate is provided with a plurality of sound transmission holes penetrating through the back plate, and the backplate is disposed on the substrate through a support arm in such a manner that a predetermined gap is formed between the backplate and the diaphragm. The plurality of stationary electrodes is arranged in a comb shape, and the plurality of movable electrodes is arranged in a comb shape. The plurality of stationary electrodes is spatially separated from the plurality of movable electrodes, and one of the plurality of stationary electrodes and one of the plurality of movable electrodes face each other. The backplate and the diaphragm form electrode plates of a variable capacitor.

As an improvement, each of the plurality of stationary electrodes includes a first top surface away from the step and a first bottom surface close to the step, and has a first thickness formed between the first top surface and the first bottom surface. Each of the plurality of movable electrodes include a second top surface away from the step and a second bottom surface close to the step, and has a second thickness formed between the second top surface and the second bottom surface. The first thickness is different from the second thickness.

As an improvement, the substrate is provided with a plurality of stationary electrode lead-out terminals for energizing the stationary electrodes and the backplate, and the diaphragm is provided with a plurality of movable electrode lead-out terminals for energizing the movable electrodes.

As an improvement, the substrate is provided with a plurality of stationary electrode lead-out terminals for energizing the plurality of stationary electrodes and a backplate lead-out terminal for energizing the backplate, and the diaphragm is provided with a plurality of movable electrode lead-out terminals for energizing the plurality of movable electrodes.

As an improvement, the connecting portion includes a plurality of connecting arms equally dividing the diaphragm, and each of the plurality of connecting arms has one end fixed to the diaphragm and another end protruding beyond a peripheral side of the diaphragm.

As an improvement, each of the plurality of movable electrode lead-out terminals for energizing the plurality of movable electrodes is disposed on one of the plurality of connecting arms.

As an improvement, the plurality of connecting arms includes four connecting arms.

As an improvement, each of the plurality of connecting arms acts as a mechanical spring.

As an improvement, the vibration portion is in a centrally symmetric shape.

As an improvement, the vibration portion is in a circle shape or a square shape.

The capacitive microphone includes a first capacitor composed of stationary electrodes and movable electrodes and a second capacitor composed of a diaphragm and a backplate, so that the first capacitor and the second capacitor output electrical signals, respectively. Phase compensation can be performed by the output of dual-capacitor electrical signals of the capacitive microphone, so that the capacitive microphone can obtain a higher signal-to-noise ratio, improve the capability of suppressing linear distortion, and improve the anti-interference capability of the microphone.

DESCRIPTION OF REFERENCE NUMERALS

1: substrate, 11: cavity, 12: step;
2: diaphragm, 21: vibration portion, 22: connecting portion;
3: stationary electrode, 31: first top surface, 32: first bottom surface;
4: movable electrode, 41: second top surface, 42: second bottom surface;
5: backplate, 51: sound transmission hole, 52: support arm.

DESCRIPTION OF EMBODIMENTS

Embodiments of the present disclosure will be described in detail in the following description, examples of which are shown in the accompanying drawings. The same or similar elements with the same or similar functions are indicated by the same or similar reference signs throughout the description. The embodiments described below with reference to the accompanying drawings are illustrative, and intend to construe the present disclosure, instead of limiting the present disclosure thereto.

Figure 1:
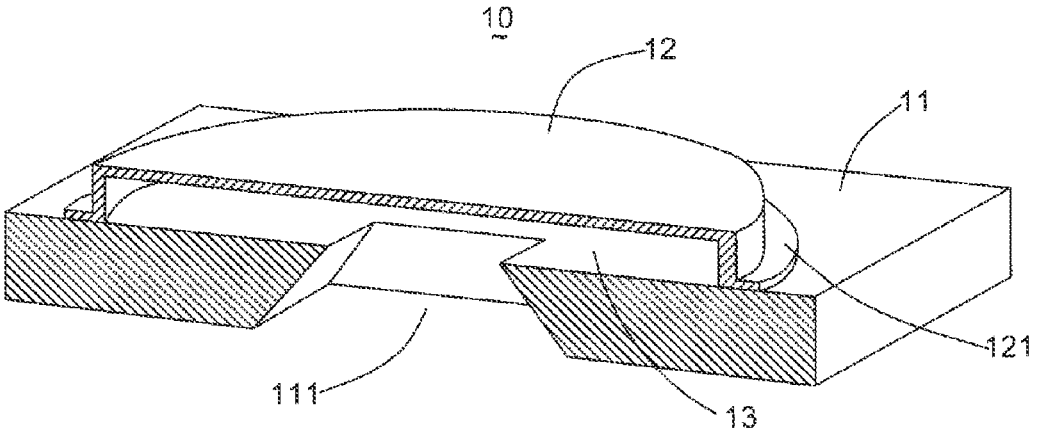
FIG. 1 is a schematic cross-sectional view of a microphone in the related art.
Figure 2:
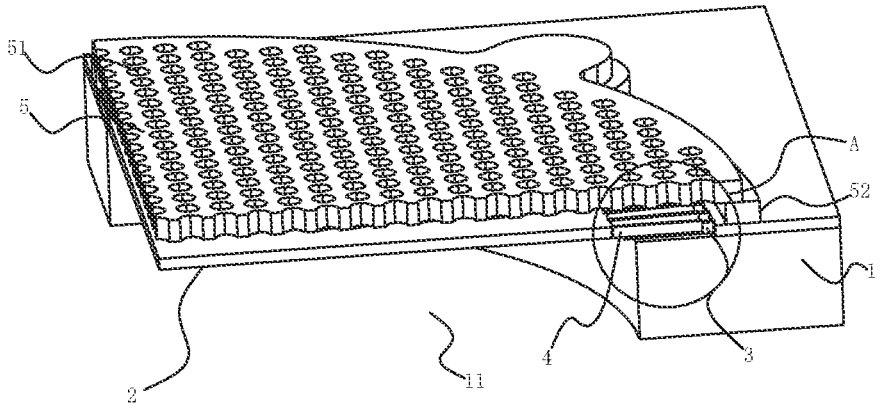
FIG. 2 is a perspective diagram of a portion of a capacitive microphone according to an embodiment of the present disclosure.
Figure 3:
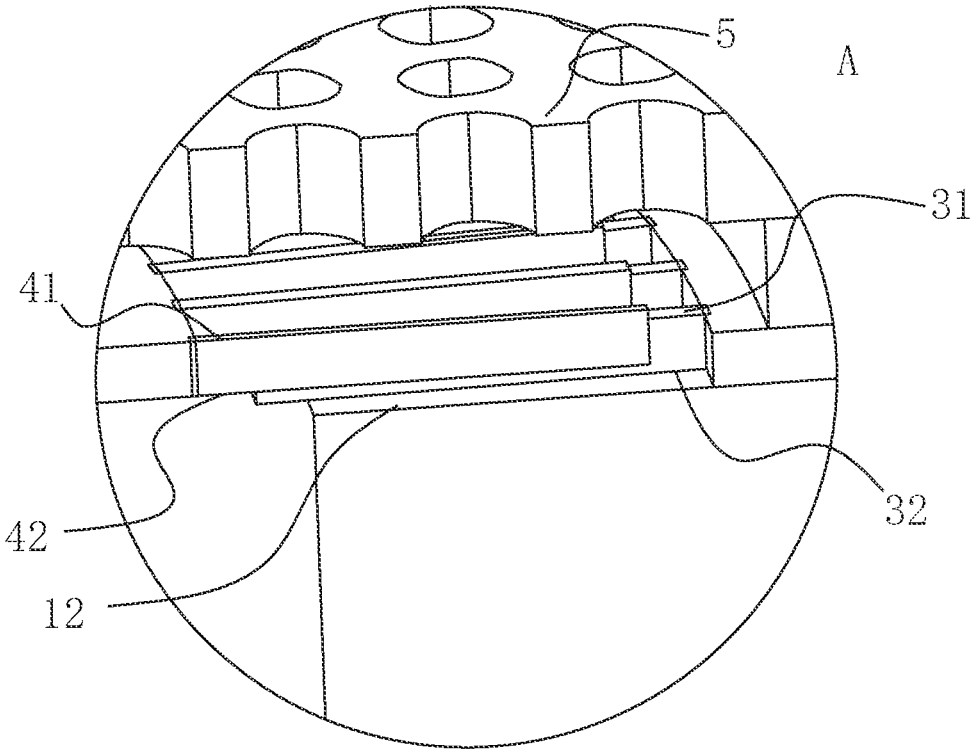
FIG. 3 is an enlarged structural view of a portion A of the capacitive microphone shown in FIG. 2.
Figure 4:
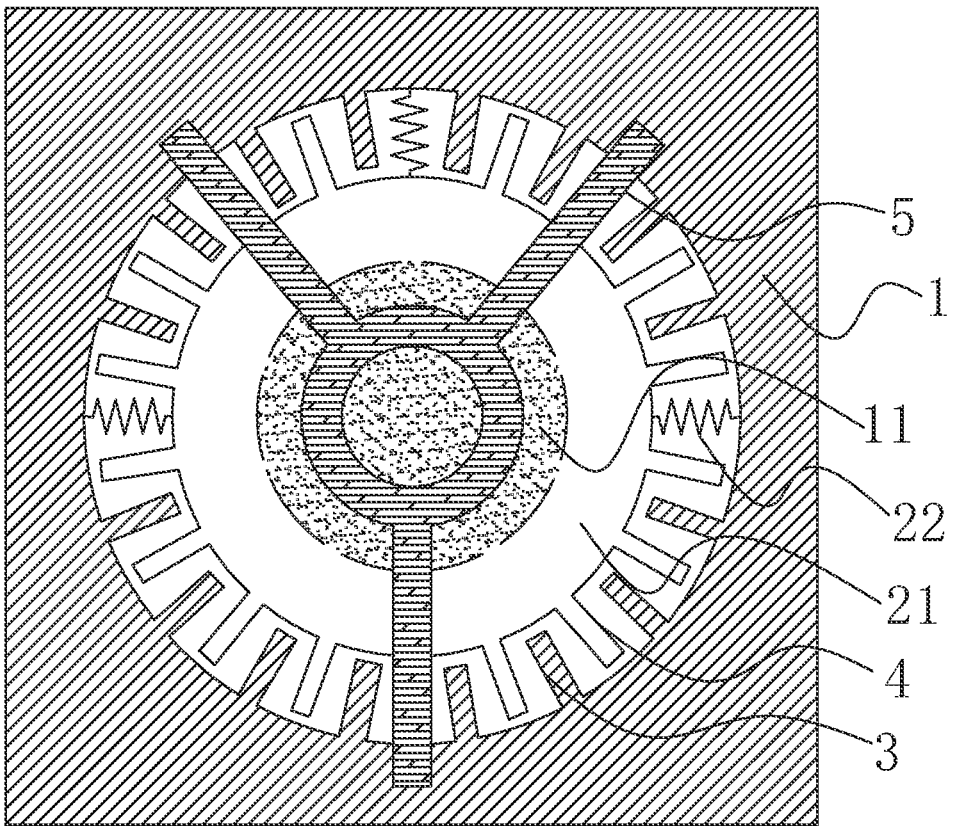
FIG. 4 is a top cross-sectional view of a capacitive microphone according to an embodiment of the present disclosure.
Figure 5:
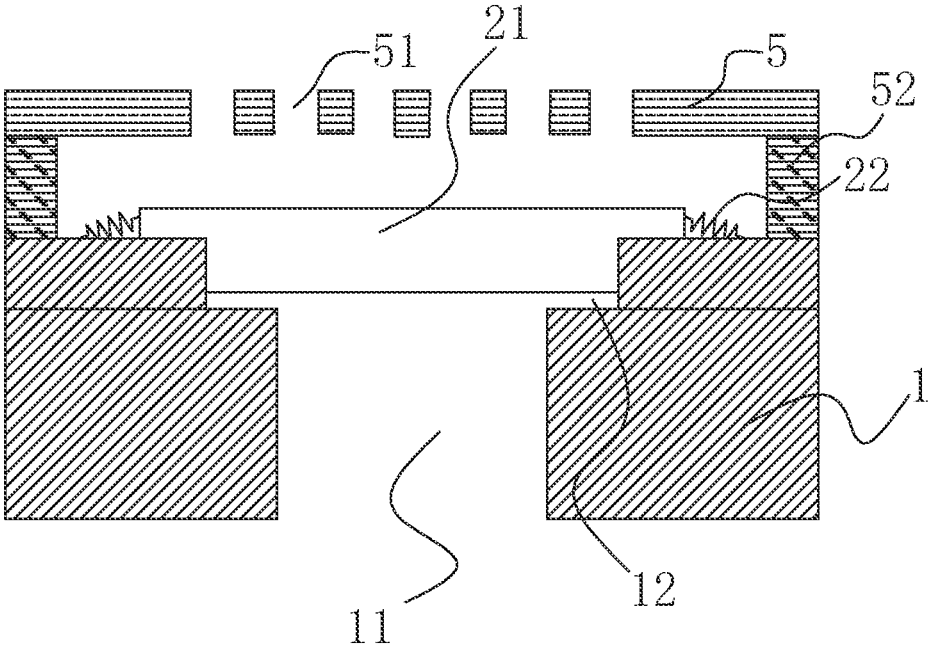
FIG. 5 is a side cross-sectional view of a capacitive microphone according to an embodiment of the present disclosure.

In some embodiments, a capacitive microphone of the present disclosure includes a substrate 1, a vibration diaphragm 2, a plurality of stationary electrodes 3, and a backplate 5, as shown in FIG. 2 to FIG. 5.

The substrate 1 includes a cavity 11 penetrating therethrough and a step 12 disposed in an upper portion of the cavity. In at least embodiment, the cavity 11 has an inner circular-contour surface.

The plurality of stationary electrodes 3 is disposed on the step 12 and equally spaced apart from each other. In some embodiments, the plurality of stationary electrodes 3 are annularly and equally spaced around a central axis of the cavity 11, and extension lines of axes of the plurality of stationary electrodes 3 are converged at a center of the cavity 11. The stationary electrodes 3 may be integrally formed in a monocrystalline substrate 1, or may be formed of a deposit layer that is formed by depositing a material such as crystalline silicon or polysilicon through a process, e.g., epitaxy process, Chemical Vapor Deposition, or other deposition techniques.

The vibration diaphragm 2 is received in the step 12, and includes a vibration portion 21 and a connecting portion 22 connected to the vibration portion 21. A plurality of movable electrodes 4 is provided at a periphery of the vibration portion 21 and protrude therefrom. In some embodiments of the present disclosure, the vibration portion 21 is in a circular shape, and extension lines of axes of the plurality of movable electrodes 4 are converged at a center of the vibration portion 21. One end of the connecting portion 22 away from the vibration portion 21 is connected to the substrate 1. For example, the one end of the connecting portion 22 is connected to the substrate 1 in an elastic connection manner, so that the vibration diaphragm 2 vibrates under the sound wave.

In some embodiments, the capacitive microphone may include a first capacitor that is composed of the stationary electrodes 3 and the movable electrodes 4. The stationary electrodes 3 are arranged in a comb shape, and the movable electrodes 4 are arranged in a comb shape. The stationary electrodes 3 are spatially separated from the movable electrodes 4, and one of the stationary electrodes 3 faces to two adjacent ones of the movable electrodes 4. Dimensions of the stationary electrodes 3 and the movable electrodes 4 define an overlapping region. When the diaphragm 2 moves upwards and downwards, an area of the overlapping region changes and the capacitance of a sensor changes. In this way, the capacitance change is related to an input pressure sound wave for driving the diaphragm 2. The capacitive microphone with this structure provides the relatively large displacement, relatively low distortion, and high sensitivity.

A backplate electrode is connected to the backplate 5. A plurality of sound transmission holes 51 penetrates through the backplate 5. The backplate 5 is disposed on the substrate 1 through a support arm 52 such that a predetermined gap is formed between the backplate 5 and the diaphragm 2. Further, the diaphragm 2 is connected with a diaphragm electrode. The backplate 5 is capacitively coupled with the diaphragm 2. In some embodiments, the capacitive microphone may include a second capacitor that is composed of the backplate 5 and the diaphragm 2. The backplate 5 and the diaphragm 2 form electrode plates of the variable capacitor. In this embodiment, the sensing under a sound pressure occurs between the stationary electrodes 3 and the movable electrodes 4 or between the diaphragm 2 and the backplate 5. In another embodiment, the sensing under a sound pressure occurs between the stationary electrodes 3 and the movable electrodes 4, and between the diaphragm 2 and the backplate 5.

When the microphone is energized, the backplate 5 and the diaphragm 2 can be charged with opposite polarities to form capacitance. When the diaphragm 2 vibrates under the sound, a distance between the diaphragm 2 and the backplate 5 is changed so that the capacitance of the second capacitor is changed, which converts a sound signal into an electrical signal and realizes a corresponding function of the microphone.

In some embodiments, the first capacitor is composed of the stationary electrodes 3 and the movable electrodes 4 and the second capacitor is composed of the diaphragm 2 and the backplate 5, such that the first capacitor and the second capacitor output electrical signals, respectively. Phase compensation can be performed by the output of dual-capacitor electrical signals of the capacitive microphone, so that the capacitive microphone can achieve a higher signal-to-noise ratio, improve the capability of suppressing linear distortion, and improve the anti-interference capability of the microphone. Accordingly, a signal transmission distance is relatively long, and the audio performance of the microphone is good.

Each of the stationary electrodes 3 includes a first top surface 31 away from the step 12 and a first bottom surface 32 close to the step 12, and has a first thickness between the first top surface 31 and the first bottom surface 32. Each of the movable electrodes 4 includes a second top surface 41 away from the step 12 and a second bottom surface 42 close to the step 12, and has a second thickness between the second top surface 41 and the second bottom surface 42.

The capacitance is directly proportional to a surface area of each of two capacitive plates of the capacitor and is inversely proportional to a distance between the two capacitive plates of the capacitor, i.e., $C=k\varepsilon_0\varepsilon_r S/d$, where each of k, $\varepsilon_0$, and $\varepsilon_r$ is a constant. After the capacitive microphone is manufactured, the values of $\varepsilon_0$ and $\varepsilon_r$ are constant. S is the surface area of each of two capacitive plates of the capacitor, and d is the distance between the two capacitor plates. Therefore, in the capacitive microphone of the present application, the stationary electrodes 3 are arranged in a comb shape and the movable electrodes 4 are arranged in a comb shape. The stationary electrodes 3 are spatially separated from the movable electrodes 4, and one of the stationary electrodes 3 and one of the movable electrodes 4 face each other. In this way, after the stationary electrodes 3 and the movable electrodes 4 are energized, a capacitance is formed between the stationary electrodes 3 and the movable electrodes 4, and the distance d therebetween remains unchanged. The surface area depends on an opposing area between the first thickness and the second thickness. Therefore, the microphone has good linearity. Moreover, the capacitance is not limited by the dimension of the diaphragm 2, so that the structure of the diaphragm 2 can be effectively reduced, which facilitate miniaturization. The number of masks for processing is less and the processing technology is simple.

In some embodiments, the first thickness is different from the second thickness, which further improves the performance of the microphone.

Further, the substrate 1 is provided with a plurality of stationary electrode lead-out terminals for energizing the stationary electrodes 3 and the backplate 5, and the diaphragm 2 is provided with a plurality of movable electrode lead-out terminals for energizing the movable electrodes 4. Each of the plurality of connecting arms has one end fixed to the vibration diaphragm and another end protruding beyond a peripheral side of the diaphragm. In this way, the backplate 5 can be connected to the same led-out circuit as for the stationary electrodes 3.

In some embodiments, the substrate 1 is provided with a plurality of stationary electrode lead-out terminals for energizing the stationary electrodes 3 and a backplate lead-out terminal for energizing the backplate 5, and the diaphragm 2 is provided with a plurality of movable electrode lead-out terminals for energizing the movable electrodes 4. In this case, the backplate is connected to an additional lead-out circuit, allowing to control independently the capacitance between the backplate and the diaphragm and eventually controlling the output signal distortion and the sensitivity of the microphone.

The connecting portion 22 includes a plurality of connecting arms equally dividing the diaphragm 2, each of the plurality of the connecting arms has one end fixed to the diaphragm 2 and another end protruding beyond a peripheral side of the diaphragm 2. When the vibration portion 21 is in a circular shape, the connecting arms direct to a center of the diaphragm 2. The plurality of connecting arms 4 includes four connecting arms equally dividing the diaphragm 2. Each of the movable electrode lead-out terminals for energizing the movable electrodes 4 is disposed on one of the connecting arms. It should be noted that the number of the connecting arms is not limited to four, and the plurality of connecting arms may include two, five or six connecting arms and other numbers of the connecting arms are possible.

The connecting arm may be in various shapes to increase the displacement of the diaphragm 2 when subjected to a sound wave, to improve the performance of the microphone. The connecting arm includes, but is not limited to, a rectangular arm, a curved arm, a triangular arm or a combination thereof.

In some embodiments, each of the connecting arms acts as a mechanical spring. The spring may be made of a material that is the same as that of the vibration portion 21, or may be made of another material or several materials. For example, the vibration portion 21 can be made of monocrystalline silicon, silicon nitride, silicon oxide, polysilicon, polyimide, or a combination thereof.

In some embodiments of the present disclosure, the shape of the vibration portion 21 of the diaphragm 2 is not limited to a circle shape, and can also be a square or other centrally symmetric shapes.

The structure, characteristics, and effects of the present disclosure are described in detail according to the embodiments illustrated. The above are merely some embodiments of the present disclosure. However, the scope of implementation of the present disclosure is not limited by the drawings. Any change or equivalent modifications made in accordance with the conception of the present disclosure without exceeding the spirit covered by the specification and diagrams, shall fall within the protection scope of the present disclosure.

What is claimed is:

1. A capacitive microphone, comprising:

a substrate comprising a cavity and a step disposed in an upper portion of the cavity, the cavity penetrating through the substrate;

a plurality of stationary electrodes equally spaced on the step;

a diaphragm received in the step and comprising a vibration portion and a connecting portion connected to the vibration portion, a plurality of movable electrodes protruding from a periphery of the vibration portion, and one end of the connecting portion away from the vibration portion being connected to the substrate; and a backplate provided with a plurality of sound transmission holes penetrating through the backplate, and the backplate being disposed on the substrate through a support arm in such a manner that a predetermined gap is formed between the backplate and the diaphragm, wherein the plurality of stationary electrodes is arranged in a comb shape, the plurality of movable electrodes is arranged in a comb shape, the plurality of stationary electrodes is spatially separated from the plurality of movable electrodes, and one of the plurality of stationary electrodes and one of the plurality of movable electrodes face each other; and wherein the backplate and the diaphragm form electrode plates of a variable capacitor.

2. The capacitive microphone as described in claim 1, wherein each of the plurality of stationary electrodes comprises a first top surface away from the step and a first bottom surface close to the step, and has a first thickness formed between the first top surface and the first bottom surface;

each of the plurality of movable electrodes comprises a second top surface away from the step and a second bottom surface close to the step, and has a second thickness formed between the second top surface and the second bottom surface; and the first thickness is different from the second thickness.

3. The capacitive microphone as described in claim 1, wherein the substrate is provided with a plurality of stationary electrode lead-out terminals for energizing the plurality of stationary electrodes and the backplate; and the diaphragm is provided with a plurality of movable electrode lead-out terminals for energizing the plurality of movable electrodes.

4. The capacitive microphone as described in claim 1, wherein the substrate is provided with a plurality of stationary electrode lead-out terminals for energizing the plurality of stationary electrodes and a backplate lead-out terminal for energizing the backplate; and the diaphragm is provided with a plurality of movable electrode lead-out terminals for energizing the plurality of movable electrodes.

5. The capacitive microphone as described in claim 1, wherein the connecting portion comprises a plurality of connecting arms equally dividing the diaphragm, and each of the plurality of connecting arms has one end fixed to the diaphragm and another end protruding beyond a peripheral side of the diaphragm.

6. The capacitive microphone as described in claim 5, wherein each of the plurality of movable electrode lead-out terminals for energizing the plurality of movable electrodes is disposed on one of the plurality of connecting arms.

7. The capacitive microphone as described in claim 5, wherein the plurality of connecting arms comprises four connecting arms.

8. The capacitive microphone as described in claim 5, wherein each of the plurality of connecting arms acts as a mechanical spring.

9. The capacitive microphone as described in claim 1, wherein the vibration portion is in a centrally symmetric shape.

10. The capacitive microphone as described in claim 9, wherein the vibration portion is in a circle shape or a square shape.

* * * * *